US010214841B1

(12) United States Patent
Bailey

(10) Patent No.: US 10,214,841 B1
(45) Date of Patent: Feb. 26, 2019

(54) NEEDLE INSERTER FOR EMBROIDERY NEEDLES

(71) Applicant: Michael L. Bailey, Georgetown, OH (US)

(72) Inventor: Michael L. Bailey, Georgetown, OH (US)

( * ) Notice: Subject to any disclaimer, the term of this patent is extended or adjusted under 35 U.S.C. 154(b) by 19 days.

(21) Appl. No.: 15/656,695

(22) Filed: Jul. 21, 2017

(51) Int. Cl.
*D05B 55/04* (2006.01)
*D05C 11/04* (2006.01)

(52) U.S. Cl.
CPC ..... *D05B 55/04* (2013.01); *D05C 11/04* (2013.01)

(58) Field of Classification Search
CPC ..... D05B 55/00; D05B 55/02; D05B 5/04; D05B 55/06; D05C 11/02; D05C 11/04
USPC ..... D3/28; D15/72
See application file for complete search history.

(56) References Cited

U.S. PATENT DOCUMENTS 1,419,718 A * 6/1922 Chertok ..... D05B 83/00 112/261
1,816,812 A * 8/1931 Allison ..... B25F 1/04 7/167
3,085,527 A * 4/1963 Stausser ..... D05B 55/04 112/225
3,348,287 A * 10/1967 Orlando ..... B68G 15/00 29/432.1
4,445,893 A * 5/1984 Bodicky ..... A61M 25/0606 604/165.04
4,989,528 A * 2/1991 Fujita ..... D05B 55/04 112/226
5,762,012 A * 6/1998 Kawamura ..... D05B 49/00 112/163
2005/0061037 A1* 3/2005 Shwartz ..... D05B 55/04 66/1 R

FOREIGN PATENT DOCUMENTS

CN 204621869 U * 9/2015
JP 2002113275 A * 4/2002
JP 2007151777 A * 6/2007

* cited by examiner

*Primary Examiner* — Ismael Izaguirre
(74) *Attorney, Agent, or Firm* — Mark F. Smith; Smith Brandenburg Ltd

(57) ABSTRACT

A needle inserter comprising an elongated handle having a first end portion and a second end portion, a releasable support at the first end portion and an elongated element extending perpendicularly from the first end portion and includes a perpendicular extending distal end. The needle inserter operates such that an embroidery needle is supported on the needle inserter by the releasable support and by the distal end. The needle inserter further operates to allow a user to hold the needle inserter to move the embroidery needle such that the embroidery needle engages with the retaining member such that the embroidery needle is retained in its proper orientation and alignment and to allow the user to move the needle inserter such that the embroidery needle disengages from the needle inserter.

7 Claims, 7 Drawing Sheets

NEEDLE INSERTER FOR EMBROIDERY NEEDLES

BACKGROUND OF THE INVENTION

The subject invention is directed to embroidery needs and, more particular to a needle inserted for use in replacing a needle used in an embroidery machine.

Embroidery machines used for forming an embroidery pattern on fabric typically use a plurality of removable needles each extending in a vertical direction and maintained in position by a retaining member or clamp that operates to secure the shank portion of the needle. The needles used with embroidery machines include a shaft having an upper portion shank for attaching to the retaining member, such as by use of a retaining screw that contacts the shank to lock the needle in position, a lower section having an eye and a longitudinally extending groove that when the needle is positioned on the embroidery machine the longitudinally extending groove faces directly outwardly and a scarf that when the needle is positioned on the embroidery machine faces directly towards the machine. Thread for use in creating embroidery is supplied to each needle from a number of respective thread spools. The thread is directed from a spool and placed along the longitudinally extending groove and through the front of the eye of the needle. In operation, the needle in a reciprocating movement is directed through an opening in a pressure foot and punches through the fabric such that a loop is formed when the needle pulls the thread through the fabric, which is caught by a rotating bobbin hook.

Unfortunately, during the embroidery process needles can bend or break. Further, the eye of the embroidery needle can wear resulting in thread breakage. Accordingly, it is often necessary or desirable to replace an embroidery needle. Replacement of a needle is generally performed by loosening the retaining member or clamp, such as loosening the screw, such that the embroidery needle can be pulled downwardly until it disengages from the embroidery machine. A replacement needle can then be installed by an operator using his hands to insert the shank portion of the embroidery needle by sliding the needle upwardly into engagement with the retaining member or clamp. While the operator using his hand holds the needle in position, the needle is locked into position, such as by tightening the retaining screw. Tread is then pulled from the spool and placed along the longitudinally extending groove of the needle and the free end of the tread is inserted through the front of the eye of the needle.

One difficulty in replacing an embroidery needle is that it is often difficult to align the needle such that is in a true vertical position and orientation with respect to the embroidery machine and to maintain the needle in position while tightening the retaining member or clamp. Needles that are not properly aligned or orientated will more likely bend or break during operation or cause loop failure and thread breaks.

Accordingly, it would be desirable to have a needle inserter that can be used to place an embroidery needle in proper orientation and alignment while being inserting and attached to the retaining member or clamp. It would also be desirable for such a needle inserter to be relatively inexpensive to manufacture and is relatively simple in design.

SUMMARY OF THE INVENTION

The subject invention is a needle inserter for embroidery needles for use in inserting a needle in an embroidery machine. The needle inserter comprises an elongated handle having a first end portion and a second end portion, a releasable support at the first end portion and an elongated element extending perpendicularly from the first end portion with a perpendicular extending distal end. The needle inserter operates such that the releasable support engages an embroidery needle along an upper portion of the shaft and the perpendicular extending distal end of the elongated element extends through the eye of the embroidery needle thereby securely supporting the needle in position on the needle inserter. The needle inserter and embroidery needle are then moved upwardly such that the shank portion of the needle engages with the retaining member and is secured to the embroidery machine such that the embroidery needle is in its proper orientation and alignment. After the embroidery needle has been secured in place on the embroidery machine, the user (or operator) then moves the needle inserter such that the perpendicular extending distal end of the elongated element no longer extends through the eye of the embroidery needle and the releasable support separates from the embroidery needle.

A preferred embodiment of the invention is a needle inserter that attaches to an embroidery needle having an elongated shaft with an upper shank portion, an eye positioned at the lower section of the shaft and a longitudinally extending groove, the needle inserter comprises an elongated handle having a first end portion and a second end portion, a releasable support at the first end portion, and an elongated element extending perpendicularly from the first end portion and having a perpendicular extending distal end that operates to attach to the shaft of the embroidery needle.

In a preferred embodiment of the invention the needle inserter operates such that the releasable support cooperates with the perpendicular extending distal end of the elongated element to maintain the embroidery needle in position on the needle inserter such that the user holding the second end portion of the elongated handle directs the embroidery needle upwardly to engage with and secure the embroidery needle to the retaining member such that the embroidery needle is in its proper orientation and alignment.

In a preferred embodiment of the invention after the embroidery needle has been secured in place, the user then moves the needle inserter away from the embroidery needle such that the needle inserter operates to disengage from the distal end of the elongated element and separates from the releasable support.

In a preferred embodiment of the invention the releasable support is in the form of a clamp having two generally elastic arms that operate to support the embroidery needle on the needle inserter and flex outwardly to release the embroidery needle from position on the needle inserter.

In a preferred embodiment of the invention the releasable support is in the form of a magnet that operates to magnetically hold the embroidery needle in place and cooperates with the distal end of the elongated element to maintain the embroidery needle on the needle inserter and to release the embroidery needle from position on the needle inserter.

In a preferred embodiment of the invention the distal end of the elongated element is magnetic that operates to magnetically hold the embroidery needle in place and cooperates with the releasable support to maintain the embroidery needle in position on the needle inserter and to release the embroidery needle after the needle has been inserted and secured in place in the retaining member of the embroidery machine.

In another preferred embodiment of the invention the needle inserter comprises an elongated handle having a first end portion and a second end portion, a releasable support at the first end portion and an elongated element extending from the first end portion and having a distal end for releasably engaging an embroidery needle and cooperates with the releasable support to support the embroidery needle in place on the needle inserter.

Another preferred embodiment of the invention is a method for replacing an embroidery needle having an elongated shaft with an upper shank portion, a lower section, an eye and a longitudinally extending groove in an embroidery machine having a retaining member and a pressure foot with an aperture for receiving the lower section of the embroidery needle, the method comprising the steps of: removing the embroidery needle from its position within the retaining member by sliding the embroidery needle downwardly until shank portion of the embroidery needle disengages from the retaining member, discarding the embroidery needle, using the needle inserter by attaching a new embroidery needle comprising an elongated shaft having an upper shank portion and a lower portion having an eye and a longitudinally extending groove into position on the needle inserter having a releasable support and an elongated element having a distal end such that an upper portion of the lower section of the shaft of the new embroidery needle engages the releasable support and the eye of the new embroidery needle engages the distal end of the elongated element thereby securing the new embroidery needle in position on the needle inserter, moving the new embroidery needle such that it engages with the retaining member, tightening the retaining member so that the upper shank portion of the elongated shaft is secured within the retaining member such that the new embroidery needle is in its proper orientation and alignment, and moving the needle inserter such that the new embroidery needle disengages from the distal end of the elongated element and separates from the releasable support.

A preferred embodiment of the invention includes the steps of removing a used embroidery needle from its position within a retaining member and sliding the used needle downwardly until the used embroidery needle disengages from the retaining member, discarding the used needle, using a needle inserter having a releasable support and an elongated element having a distal end by inserting the shaft of a new embroidery needle into position such that the releasable support and the distal end of the elongated element of the needle inserter engage the elongated shaft to secure the new embroidery needle in position on the needle inserter, moving the new embroidery needle upwardly such that the shank portion of the elongated shaft of the new embroidery needle engages with the retaining member, tightening the retaining member so that the shank portion of the elongated shaft is secured within the retaining member such that the new embroidery needle is in its proper orientation and alignment, then moving the needle inserter such that the shaft of the new embroidery needle is no longer engaged with the releasable support and the distal end of the elongated element.

Other advantages, objects, and embodiments of the invention will be apparent from the following description, the accompanying drawings and the appended claims.

BRIEF DESCRIPTION OF THE DRAWINGS

To provide a more complete understanding of the present invention and further features and advantages thereof, reference is now made to the following description taken in conjunction with the accompanying drawings, in which.

DETAILED DESCRIPTION OF THE INVENTION

Figure 1:
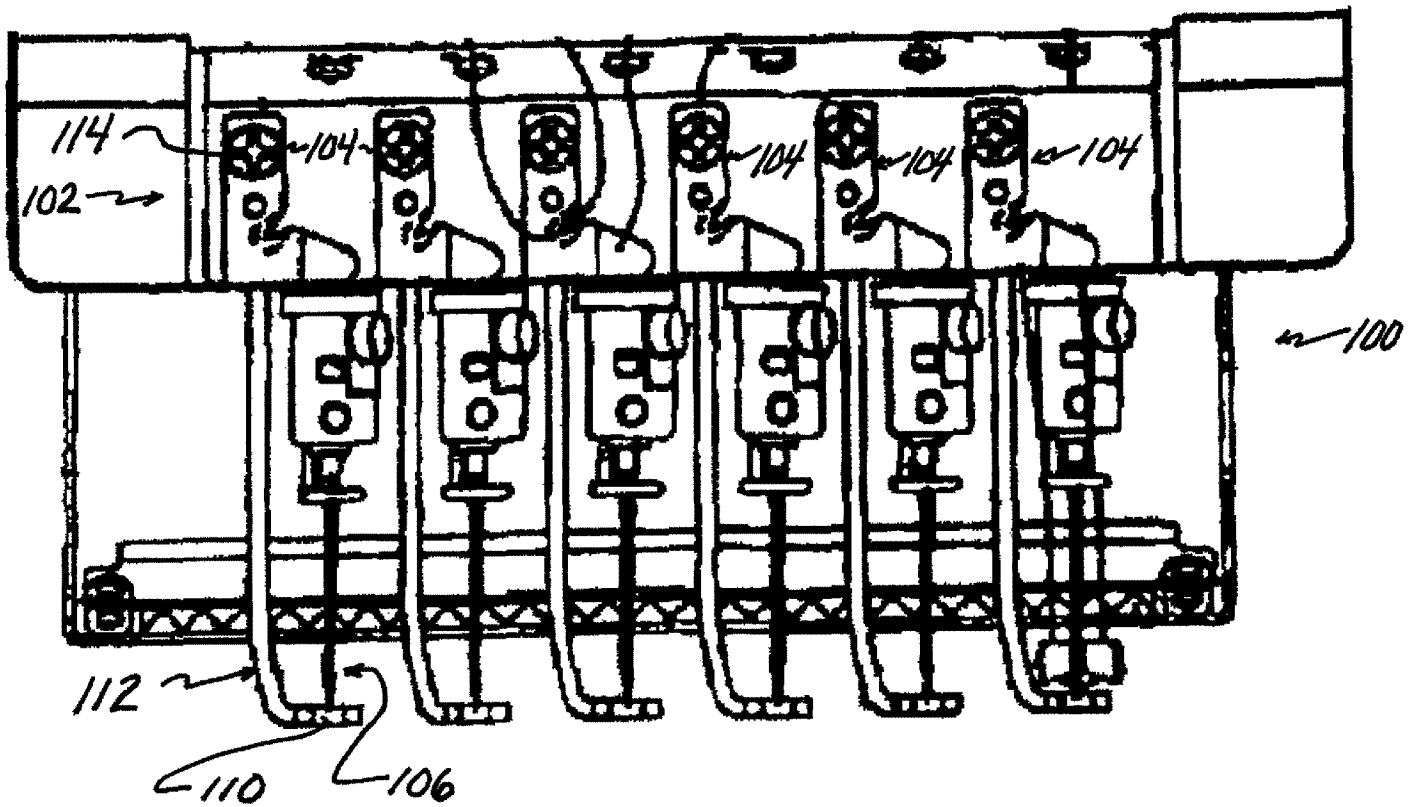
FIG 1 PRIOR ART
FIG. 1 is a schematic illustration a portion of an embroidery machine showing a plurality of embroidery needles for use in punching through a fabric to provide embroidery.

The subject invention is directed to a needle inserter for embroidery needles for use in inserting a needle in an embroidery machine. As used herein the terms "forward" or "forwardly" refer to the direction perpendicular to and horizontally away from the front side of the embroidery machine. As used herein the term "upwardly" refers to the direction vertically away from the ground and the term "downwardly" refers to the direction vertically towards the ground. In describing the preferred embodiments of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose.

Referring to FIG. 1, a multi-needle embroidery machine 100 is shown having a needle bar 102 with a plurality of retaining members 104 each supporting an embroidery needle 106 that extends vertically downwardly from the retaining member 104 such that the tip portion 108 of the embroidery needle 106 extends towards a corresponding aperture 110 in a pressure foot 112 of the embroidery machine 100. Preferably, each retaining member 104 includes a screw 114, or other similar device, that operates to tighten the retaining member 104 and secure the embroidery needle 106 in position with the retaining member 104 for operation of the embroidery machine and operates to loosen the retaining member 104 to remove the embroidery needle 106 from the embroidery machine 100.

Figure 2:
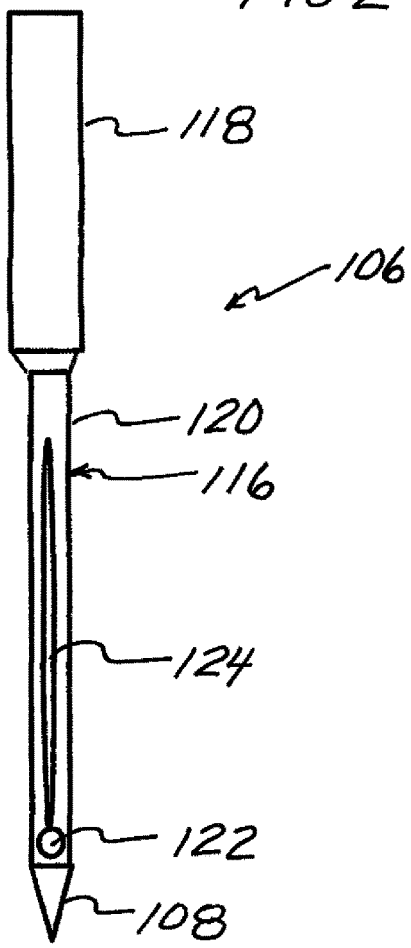
PRIOR ART FIG 2
FIG. 2 is a schematic illustration of a prior art embroidery needle showing a shaft having an upper shank portion for attaching to a retaining member for locking the needle in position, and a lower section having an eye and a longitudinally extending groove that when the needle is properly positioned on the embroidery machine faces directly outwardly.

As illustrated in FIG. 2, a non-limiting illustration of an embroidery needle 106 is shown and includes an elongated shaft 116 having an upper shank portion 118 for attaching to the retaining member 104 when in a locked position for operation of the embroidery machine 100, and a lower section 120 having a tip portion 108 and an eye 122 and a longitudinally extending groove 124 that when the embroidery needle 106 is properly positioned on the embroidery machine 100 it faces directly outwardly therefrom.

Figure 3:
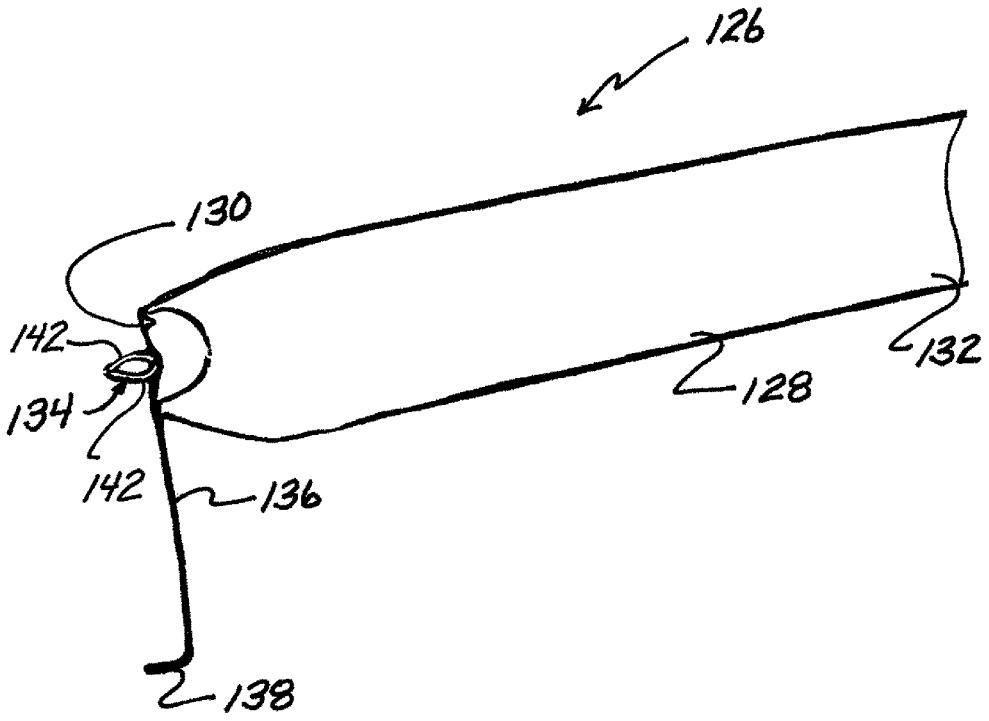
FIG. 3 is a schematic illustration of the needle inserter of the subject invention, without a needle supported thereon, that operates to support a needle while being inserted into and secured in position by the retaining member.
Figure 4:
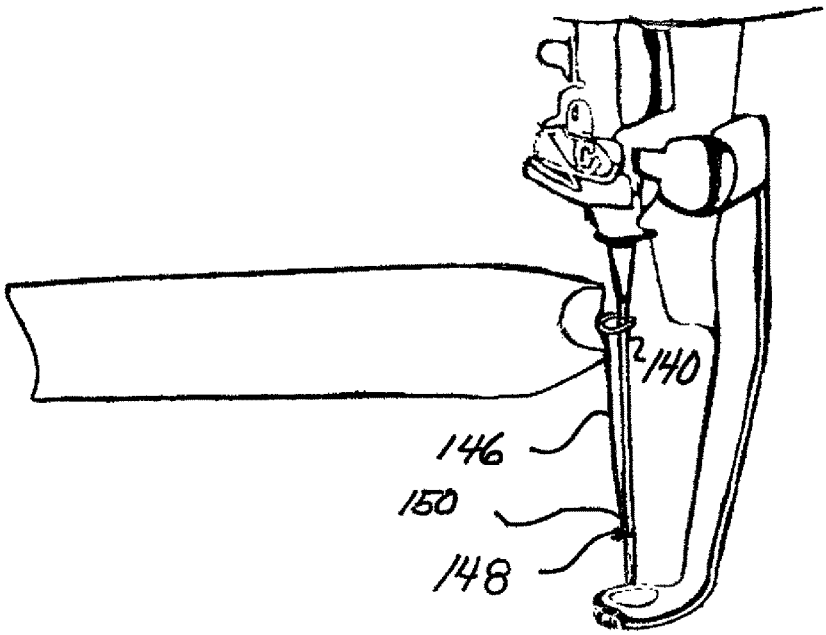
FIG. 4 is a schematic illustration of the needle inserter of FIG. 3 showing a releasable support and an elongated element having a distal end with an embroidery needle supporter thereon being used to place the embroidery needle in correct orientation and alignment on the embroidery machine.

Referring to FIGS. 3 and 4, a preferred embodiment of the needle inserter 126 of the subject invention is shown comprising an elongated handle 128 having a first end portion 130 and a second end portion 132, a releasable support 134 at the first end portion 130 and an elongated element 136 extending perpendicularly from the first end portion 130 having a perpendicular outwardly extending distal end 138. The needle inserter 126 operates such that an upper portion 140 of the lower section 120 of the elongated shaft 116 of an embroidery needle 106 engages the first end portion 130 on the needle inserter 126 by the releasable support 134 such that the distal end 138 of the elongated element 136 extends through the eye 122 of the embroidery needle 106. As shown, the elongated handle 128 is sized such that a user can comfortably hold the second end portion 132 of the elongated handle 128 in one hand during operation and is formed from wood, plastic, metal or other rigid material.

Figure 5:
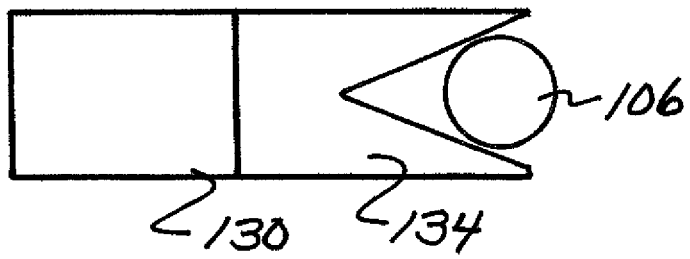
FIG. 5 is a schematic end view illustration of another preferred embodiment of the releasable support showing an embroidery needle supported thereon, wherein the releasable support is in the form of a magnet.
Figure 6:
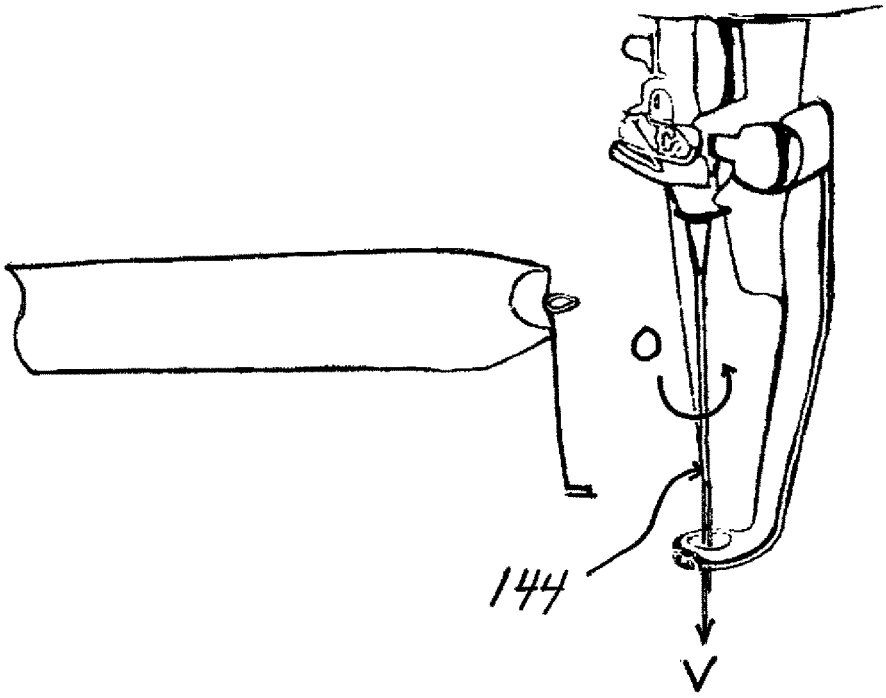
FIG. 6 is a schematic illustration of the needle inserter of FIG. 3 showing a new embroidery installed on the embroidery machine having the proper alignment and orientation.
Figure 7:
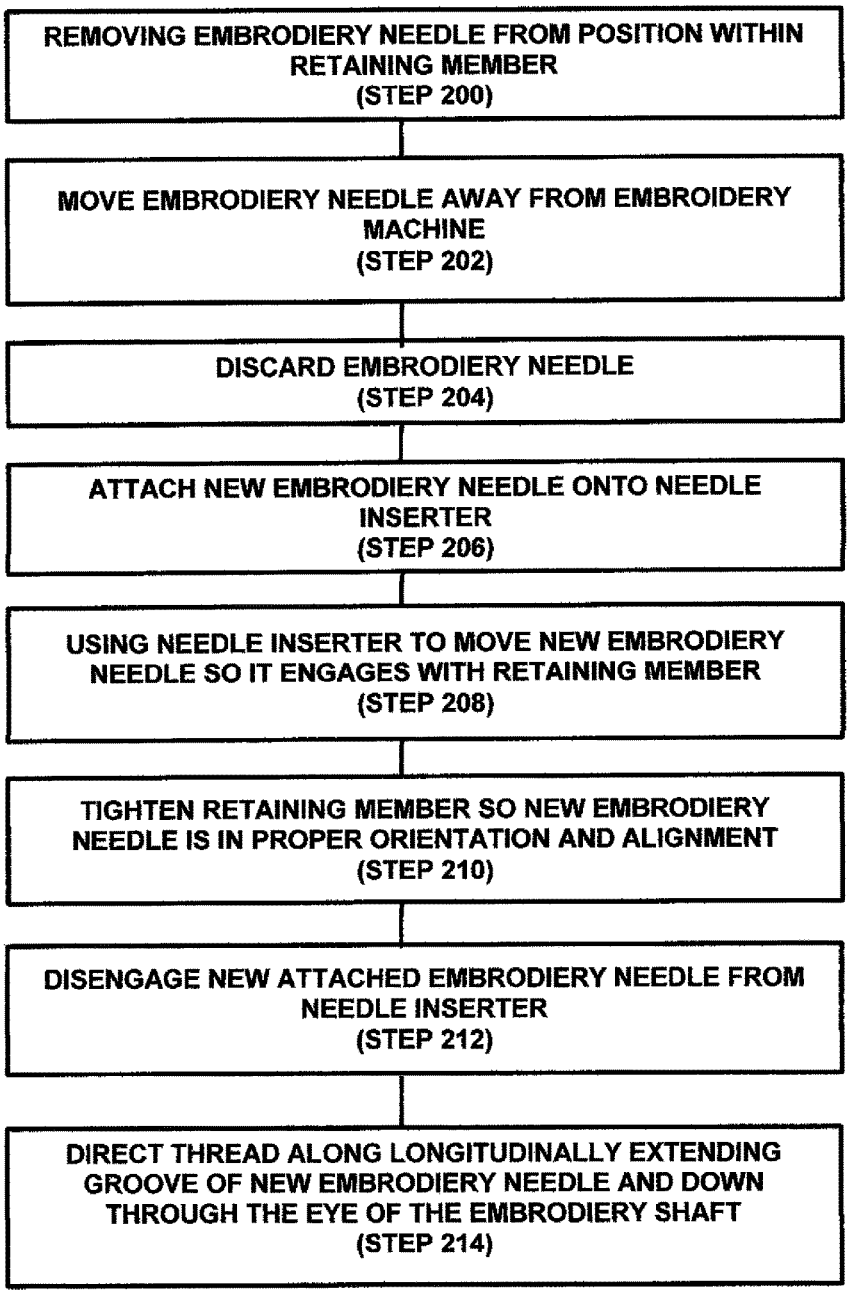
FIG. 7 illustrates the methodology and operation of a preferred embodiment utilizing a method for replacing a embroidery needle using the needle inserter of the subject invention.

In a preferred embodiment of the invention the releasable support 134 is in the form of a clamp having two generally elastic arms 142 that operate to support the embroidery needle 106 on the needle inserter 126 and flex outwardly to release the embroidery needle 106 from its position on the needle inserter 126, such as when the embroidery needle 106 has been secured in proper position in the retaining member 104. In another preferred embodiment of the invention, as illustrated in FIG. 5, the releasable support 134 is in the form of a magnet that operates to magnetically hold an embroidery needle 106 in place and cooperates with the distal end 138 of the elongated element 136 to maintain the embroidery needle on the needle inserter and to release the embroidery needle 106 from position on the needle inserter 126. In another preferred embodiment, the distal end 138 of the elongated element 136 is in the form of a magnet that operates to magnetically hold the embroidery needle 106 in place on the needle inserter 126 and cooperates with the releasable support 134 to maintain the embroidery needle on the needle inserter during insertion of the embroidery needle 106 into the retaining member 104.

Referring to the Figures, the methodology or using the needle inserter 126 of the subject invention is shown whereby a used embroidery needle 106 that is positioned within a retaining member 104 is removed from the retaining member 104, such as by loosening a screw 114, and sliding the used embroidery needle 106 downwardly until the shank portion 118 of the elongated shaft 116 of the used embroidery needle 106 disengages from the retaining member 104 (step 200). The used embroidery needle 106 is then moved away from the pressure foot 112 (step 202) and the embroidery needle discarded (step 204). The needle inserter 126 operates such that a user holding the second end portion 132 of the elongated handle 128 inserts elongated shaft 116 of a new embroidery needle 144 (replacement needle) into position such that the releasable support 134 of the needle inserter 126 engages the upper portion 140 of the lower section 120 of the elongated shaft 116 of the new embroidery needle 144 and that the distal end 138 of the elongated element 136 extends through the eye 122 of the embroidery needle 106 thereby securing the new embroidery needle 144 in position on the needle inserter 126 (step 206). Holding the second end portion 132 of the elongated handle 128, the user moves the needle inserter 126 with the new embroidery needle 144 upwardly such that the shank portion 118 of the elongated shaft 116 of the new embroidery needle 144 engages with the retaining member 104 and that the tip portion 108 or the elongated shaft 116 points vertically downward towards the aperture 110 of the pressure foot 112 (step 208). The retaining member 104 is then tightened, such as by tightening the screw 114, so that the shank portion 118 of the elongated shaft 116 is secured within the retaining member 104 such that the new embroidery needle 144 is in its proper orientation O (such that longitudinally extending groove 124 is facing properly, directly away from the embroidery machine 100) and vertical alignment (V) (step 210) so that the shaft is vertically aligned with the center of the aperture 110 of the pressure foot 112 so that during operation of the embroidery machine the needle will move in reciprocating vertical movement within specifications of the particular embroidery machine. After the new embroidery needle 144 has been secured in place, the user then moves the needle inserter 126 such that the distal end 138 of the elongated element 136 no longer extends through the eye 122 of the new embroidery needle 144 and the upper portion 140 of the elongated shaft 116 separates from the releasable support 134 (step 212). After the new embroidery needle 144 has been attached to the embroidery machine 100, the user directs thread 146 along the longitudinally extending groove 124 of the new embroidery needle 144 and inserts the free end 148 of the thread 146 through the forward face 150 of the eye 122 of the new embroidery needle 144 (step 214).

It should now be apparent that the embroidery inserter of the subject invention operates such that in the event an embroidery needle breaks a user can remove the used needle from its position within a retaining member by sliding the used needle downwardly until the it disengages from the retaining member. The used embroidery needed is then discarded. Using the needle inserter of the subject invention having a releasable support and an elongated element with a distal end, the shaft of a new embroidery needle is placed into position on the needle inserter such that the releasable support and the distal end of the elongated element of the needle inserter engages the elongated shaft of the embroidery needle to secure the new embroidery needle in position on the needle inserter. The needle inserter is then moved such that the shank portion of the elongated shaft of the new embroidery needle engages with the retaining member. The retaining member is tightened so that the shank portion of the elongated shaft is secured within the retaining member such that the new embroidery needle is in its proper orientation and alignment. The needle inserter is then moved so that the shaft of the new embroidery needle is no longer engaged with the releasable support and the distal end of the elongated element.

It should now be apparent to one skilled in the art that the needle inserter can be used to place an embroidery needle in proper orientation and alignment on an embroidery machine. It should also now be apparent that the needle inserter of the subject invention is relatively inexpensive to manufacture and is relatively simple in design. Further, the needle inserter operates such that a user can easily align the embroidery needle such that is in a true vertical position with respect to the embroidery machine and to maintain the embroidery needle and thread in position while tightening the retaining member thereby minimize the likelihood that the needle is not properly orientated and aligned thereby minimizing the likelihood that the embroidery needle will bend or break or cause loop failure and thread breaks during operation of the embroidery machine.

The invention claimed is:

1. A needle inserter for use by a user in inserting an embroidery needle having an elongated shaft with an eye and a longitudinally extending groove into a retaining member of an embroidery machine, the needle inserter comprising:

an elongated handle having a first end portion and a second end portion;

a releasable support at the first end portion; and an elongated element extending perpendicularly from the first end portion and having a perpendicular extending distal end;

wherein said releasable support operates to engage with the elongated shaft of the embroidery needle; and wherein said distal end operates to engage with the eye of the elongated shaft and cooperates with said releasable support to support the embroidery needle on the needle inserter.

2. The needle inserter of claim 1 wherein said releasable support cooperates with said distal end to maintain the embroidery needle in position on the needle inserter such that the user holding said second end portion of said elongated handle moves the needle inserter which operates to move the embroidery needle into engagement with the retaining member such that the embroidery needle is in its proper orientation and alignment.

3. The needle inserter of claim 2 wherein after the embroidery needle has been secured in place, the needle inserter operates such that when the needle inserter moves away from the inserted embroidery needle said releasable support operates to disengage from the elongated shaft of the embroidery needle.

4. The needle inserter of claim 1 wherein said releasable support is in the form of a clamp having two generally elastic arms that operate to support the embroidery needle in position on said needle inserter and flex outwardly to release the embroidery needle from position on said needle inserter.

5. The needle inserter of claim 1 wherein said releasable support is in the form of a magnet that operates to magnetically hold the embroidery needle in place and cooperates with said distal end of said elongated element to maintain the embroidery needle on said needle inserter and to release the embroidery needle from position on said needle inserter.

6. The needle inserter of claim 1 wherein said distal end of said elongated element is in the form of a magnet that operates to magnetically hold the embroidery needle in place and cooperates with said releasable support to maintain the embroidery needle on said needle inserter and to release the embroidery needle from said needle inserter.

7. A method for replacing an embroidery needle having an elongated shaft with a upper shank portion and a lower section having an eye and a longitudinally extending groove, in an embroidery machine having a retaining member, the method comprising the steps of:

removing the embroidery needle from the retaining member by sliding the embroidery needle downwardly until the embroidery needle disengages from the retaining member;

discarding the embroidery needle;

using a needle inserter by attaching a new embroidery needle into position on the needle inserter, the needle inserter comprising a releasable support and an elongated element having a distal end such that the new embroidery needle engages the releasable support and the distal end of the elongated element by inserting the distal end through the eye of the new embroidery needle thereby securing the new embroidery needle in position on the needle inserter;

moving the needle inserter so that the new embroidery needle engages with the retaining member such that the new embroidery needle is in a proper orientation and alignment;

tightening the retaining member so that the new embroidery needle is secured within the retaining member such that the new embroidery needle remains in the proper orientation and alignment; and moving the needle inserter such that the new embroidery needle is no longer supported on the needle inserter.

* * * * *